US007198506B2

(12) United States Patent
Furuya et al.

(10) Patent No.: US 7,198,506 B2
(45) Date of Patent: Apr. 3, 2007

(54) CONNECTOR

(75) Inventors: Hironobu Furuya, Kariya (JP); Masataka Nishimura, Kariya (JP); Hideaki Ohmi, Kariya (JP)

(73) Assignee: Kabushiki Kaisha Toyota Jidoshokki, Kariya-shi (JP)

( * ) Notice: Subject to any disclaimer, the term of this patent is extended or adjusted under 35 U.S.C. 154(b) by 0 days.

(21) Appl. No.: 11/202,604

(22) Filed: Aug. 12, 2005

(65) Prior Publication Data

US 2007/0037438 A1 Feb. 15, 2007

(51) Int. Cl.
*H01R 13/58* (2006.01)

(52) U.S. Cl. ..... 439/456

(58) Field of Classification Search ..... 439/456, 439/457, 468, 447, 453, 571, 575; 361/390; 174/136, 135

See application file for complete search history.

(56) References Cited

U.S. PATENT DOCUMENTS 5,921,805 A * 7/1999 Tabata et al. ..... 439/457

6,902,432 B2 * 6/2005 Morikawa et al. ..... 439/607

FOREIGN PATENT DOCUMENTS

| | | |
|---|---|---|
| JP | 55-65785 | 5/1980 |
| JP | 3-46966 | 4/1991 |
| JP | 2000-274559 | 10/2000 |

* cited by examiner

*Primary Examiner*—Alexander Gilman
(74) *Attorney, Agent, or Firm*—Morgan & Finnegan, L.L.P.

(57) ABSTRACT

A connector 11 includes a housing 12, a connector insertion portion 12*f* arranged in the housing 12 for insertion of a wire-side connector 30 at an end of an electric wire 31, and a connector connection portion (input terminals 14) arranged in the housing 12 for connection with the wire-side connector 30 when the wire-side connector 30 is inserted into the connector insertion portion 12*f*. The connector 11 includes a latch 20 located on a face of the housing 12 excluding the end face in which the connector insertion portion 12*f* is arranged such that the latch does not intersect with a hypothetical plane including that end face. The connector 11 also has legs 17. The legs 17 and the connector connection portion (input terminals 14) are each formed by parts of an L-shaped conductive member 15, and the legs 17 also function as electrode terminals.

6 Claims, 4 Drawing Sheets

CONNECTOR

BACKGROUND OF THE INVENTION

The present invention relates to a connector mounted on a printed circuit board.

In an electrical device, a large number of electrical components are mounted on a printed circuit board, which is arranged in a case. Some of such electrical components mounted on the printed circuit board are electrically connected, by means of a wire harness (lead wire), to a terminal arranged at a predetermined position on the printed circuit board. Conventionally, in order to prevent the lead wire from falling out or from getting caught in the case, a clamp component for fixing the lead wire is arranged on the printed circuit board or on an inner surface of the electrical device housing.

Japanese Laid-Open Utility Model Publication No. 55-65785 describes a connector provided with an electric wire bundling and guiding device, which bundles together a predetermined number of electric wires extending from the connector, guides them in a predetermined direction, and stably holds them in the predetermined direction. As shown in FIG. 7, in the connector, a plurality of electric wires 44 extend from a connector housing body 41. A frame 42, which is substantially T-shaped, and frames 43, which are substantially L-shaped, are integrally formed on a terminal portion 41*a* of the connector housing body 41. The substantially T-shaped frame 42 and the substantially L-shaped frame 43 are formed to extend out of the connector housing body 41 in the direction in which the electric wires 44 extend.

Japanese Laid-Open Patent Publication No. 2000-274559 describes a connector cable holding structure which is provided in an electronic device interface to prevent a cable from falling out. The connector cable holding structure has a cable guide in the vicinity of a first connector provided in the electronic equipment body. The cable guide guides a cable (electric wire) so as to bend the cable in a predetermined direction in a state in which a second connector, connected to an end of the cable, is connected to the first connector.

The cable guide and frames 42 and 43 of the conventional connector are both used to hold electric wires at a predetermined position in a state stably connected to the connector. Additionally, the cable guide and the frames are arranged to extend out of the electronic equipment body so that the wires connected to the connector are easily held. However, no consideration is given to other wires that are not connected to the connector.

Japanese Laid-Open Utility Model Publication No. 3-46966 describes a connector attached to an option harness that is branched from a wire harness. The housing of this connector is integrally provided with a pair of plastically deformable clamps. The pair of clamps are arranged to extend across the option harness and the wire harness, and the free ends of the clamps are twisted. This plastically deforms the free ends of the clamps. In this state, the connector is fixed to the wire harness together with the option harness.

However, this connector is designed to fix a connector, which is attached to an option harness, to a wire harness, and no consideration is given to a case in which the connector is mounted on a printed circuit board or connected to other types of wiring.

SUMMARY OF THE INVENTION

It is an object of the present invention to provide a connector capable of fixing a lead wire, which is arranged in the vicinity of a connector, at a predetermined position without providing any special clamp components on a printed circuit board or on the inner surface of an electrical device housing.

To achieve the above object, the present invention provides a connector including a housing. A connector insertion portion is defined in the housing for insertion of a wire-side connector that is arranged on an end of an electric wire. A connector connection portion is arranged on the housing for connection with the wire-side connector in a state in which the wire-side connector is inserted in the connector insertion portion. A latch is arranged on a face other than an end face of the housing in which the connector insertion portion is arranged such that the latch does not interfere with a hypothetical plane including the end face.

The present invention also provides a connector with a tube-shaped housing including an open end and a closed end. A connector connection portion is arranged inside the housing. A wire-side connector is inserted into the housing through the open end of the housing to connect the wire-side connector to the connector connection portion. During connection, an electric wire extends from the wire-side connector out of the housing. A latch is arranged at a side opposite side from the open end of the housing.

The present invention further provides a connector including a housing. A connector connection portion is arranged on the housing for connection to a wire-side connector that is arranged on an end of an electric wire. A latch is located on the housing at a side opposite to an end face located at a side through which the wire-side connector is inserted and to a side opposite to a side from which the electric wire extends.

BRIEF DESCRIPTION OF THE DRAWINGS

The invention, together with objects and advantages thereof, may best be understood by reference to the following description of the presently preferred embodiments together with the accompanying drawings in which:

FIG. 3(*b*) is a right side view of the connector;

FIG. 3(*c*) is a side view of a conductive member;

DESCRIPTION OF THE PREFERRED EMBODIMENTS

A connector for use in an on-vehicle DC-AC inverter device according to a preferred embodiment of the present invention will now be described with reference to the drawings.

Figure 1:
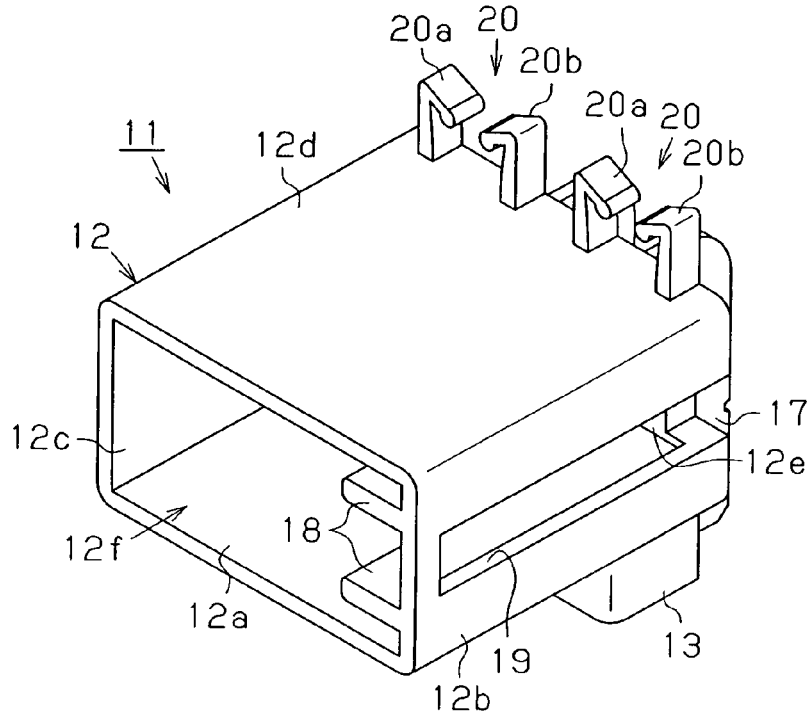
FIG. 1 is a perspective view of a connector according to an embodiment of the present invention.
Figure 2:
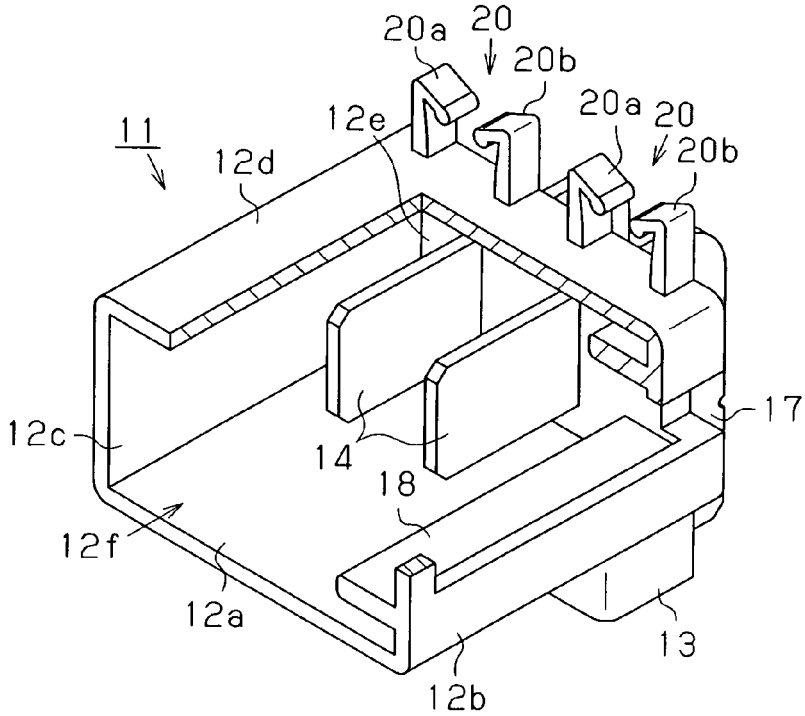
FIG. 2 is a partially cutaway perspective view of the connector.
Figure 4:
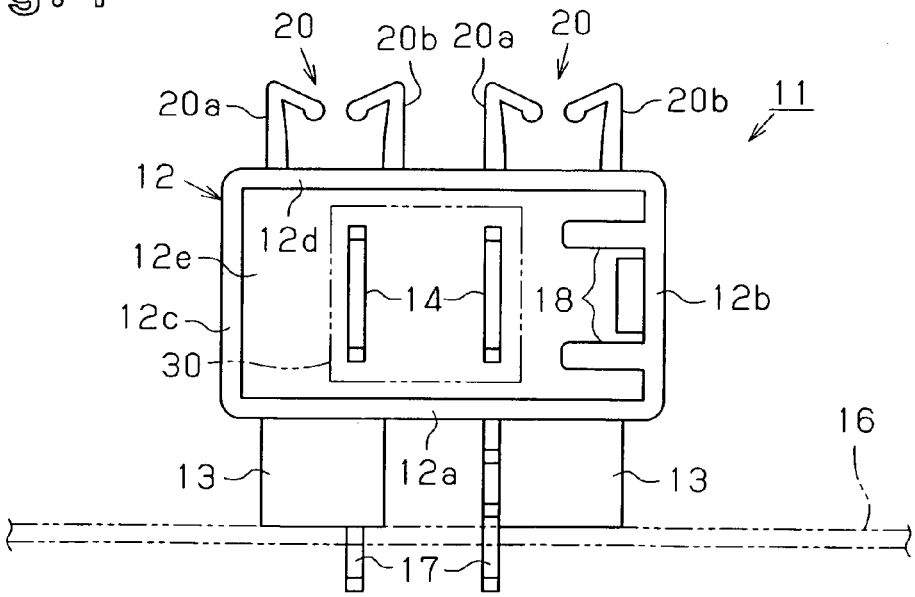
FIG. 4 is a front view of the connector.

As shown in FIGS. 1, 2 and 4, a connector 11 includes a housing 12, which is formed by a rectangular tube having a front open end and a rear closed end. The housing 12 is made of a resin and has a bottom wall 12*a*, a right side wall 12*b*, a left side wall 12*c*, a top wall 12*d*, and a rear wall 12*e*. Two attachment portions 13, which serve as legs, are provided near the rear end of the bottom wall 12*a*. The space enclosed by the bottom wall 12*a*, the right side wall 12*b*, the left side wall 12*c*, the top wall 12*d*, and the rear wall 12*e* defines a connector insertion portion 12*f*. The connector insertion portion 12*f* receives a female connector, or a wire-side connector 30 (see FIGS. 4 and 6), that is connected to an electric wire (cord) connected to a battery (not shown). In the description herein, the side wall on the right side as viewed from the front of the housing 12 is referred to as the right side wall 12*b*, while the side wall on the left side is referred to as the left side wall 12*c*.

A pair of input terminals 14 are arranged on the rear wall 12*e* of the housing 12 so as to project into the housing 12. The input terminals 14 form a male connector connection portion. The input terminals 14 are connected to the wire-side connector 30 when the wire-side connector 30 is inserted into the connector insertion portion 12*f* (See FIGS. 4 and 6).

Figure 3A:
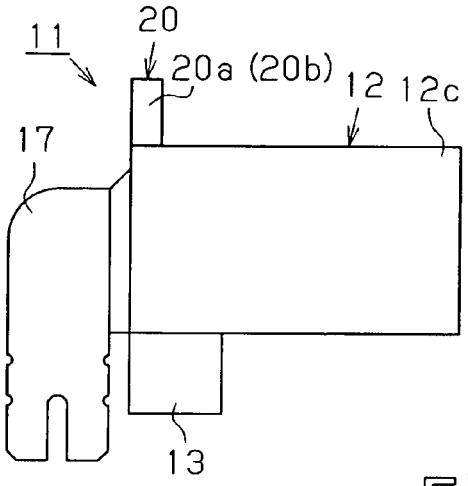
FIG. 3(*a*) is a left side view of the connector.
Figure 3B:
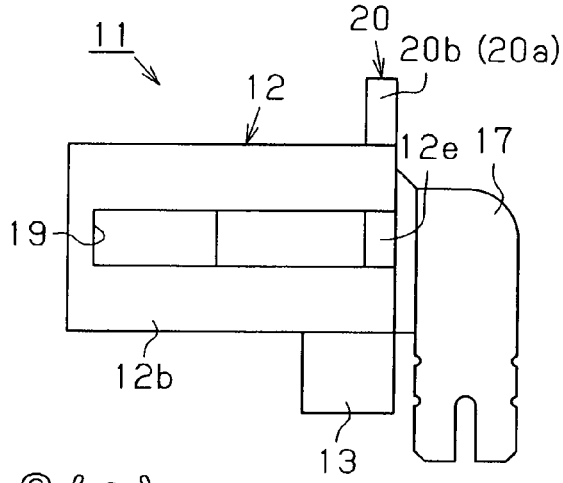
Figure 3C:
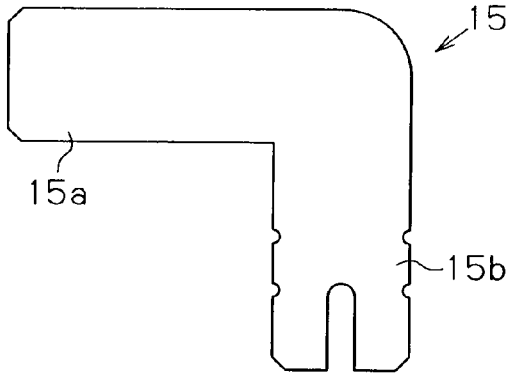

As shown in FIG. 3(*c*), the input terminals 14 are each formed by a conductive member 15, which is substantially L-shaped and includes first and second arm portions 15*a* and 15*b*. The first arm portion 15*a* is fixed to the rear wall 12*e*. The first arm portion 15*a* extends through the rear wall 12*e* of the housing 12 parallel to the side walls 12*b* and 12*c* to a position near the generally middle portion of the housing 12 in the longitudinal direction.

The second arm portion 15*b* of the conductive member 15 extends, outside the housing 12, downward from the attachment portion 13 parallel to the rear wall 12*e*. The connector 11 is designed such that the lower end of the second arm portion 15*b* is inserted through an insertion hole (not shown) formed in the printed circuit board 16 indicated by the double dotted chain line FIG. 4. Thus, the second arm portion 15*b* forms a leg 17, which fixes the connector 11 to the printed circuit board 16.

As shown in FIGS. 1 and 4, a pair of guide portions 18 are provided on the inner surface of the right side wall 12*b* at positions corresponding to the input terminals 14 such that the guide portions 18 extend parallel to the bottom wall 12*a* and the top wall 12*d*. Further, a window 19 is formed in the right side wall 12*b* between the guide portions 18 so as to extend substantially over the whole length of the right side wall 12*b*.

As shown in FIGS. 1, 2, and 4, latches 20 are formed on the top wall 12*d* of the housing 12 rearward from the front end of the housing 12, that is, at the side opposite to the side from which electric wires extend from the end face of the housing 12 that is located on the side the wire-side connector is inserted. The latches 20 project vertically from the wall surface of the housing 12. A latch 20 is formed by two latching pieces 20*a* and 20*b*. In this embodiment, there are two latches 20. Each of the latching pieces 20*a* and 20*b* includes a part extending vertically from the top wall 12*d* and a flexible hook bent at an acute angle with respect the vertical part. In other words, the latch 20 projects vertically from the top wall 12*d* of the housing 12. The distal ends of the latching pieces 20*a* and 20*b* face each other with the distance therebetween set to be smaller than the thickness of an electric wire.

Figure 5:
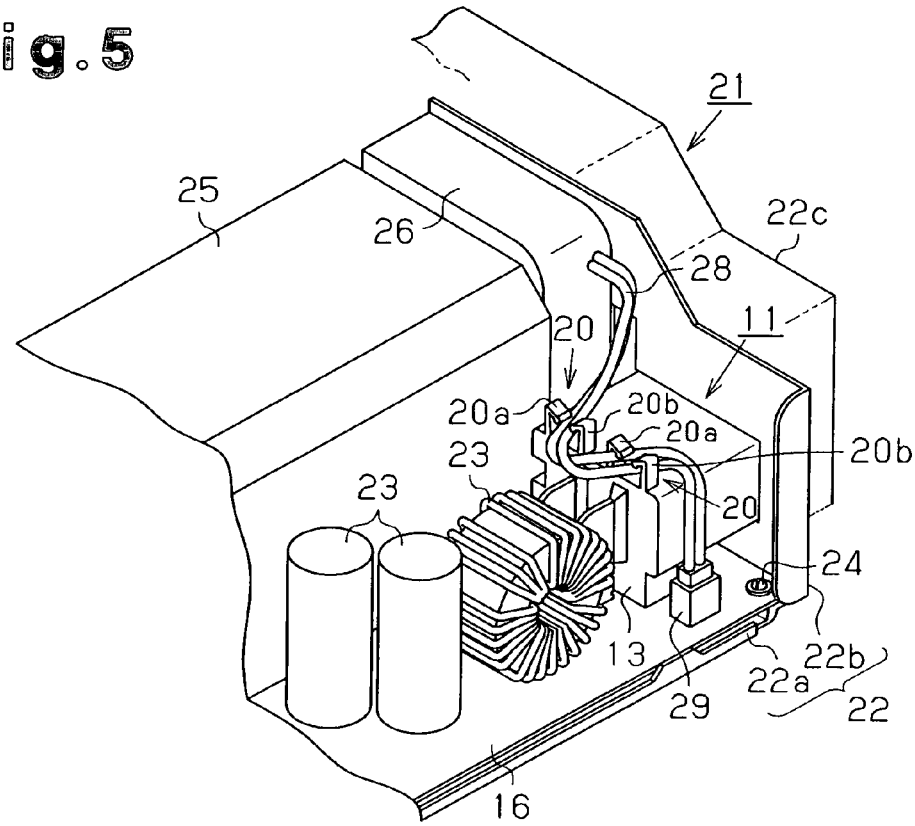
FIG. 5 is a partial schematic perspective view of a DC-AC inverter device with its cover member removed.

The above connector 11 is for use in an on-vehicle DC-AC inverter device. As shown in FIG. 5, a DC-AC inverter device 21 includes a case 22, a printed circuit board 16 arranged in the case 22, electrical components 23 mounted on the printed circuit board 16, and a cover member 22*c*. The case 22 is formed by an assembly of a base plate 22*a* and a side plate 22*b*. The printed circuit board 16 is fixed to the base plate 22*a* by plurality of screws 24 (only one shown). The electrical components 23 may be a capacitor, a coil, and so on. A heat sink 25 is attached to the printed circuit board 16. A heating element such as a power transistor (not shown) is fixed to the heat sink 25. A cooling fan unit 26 is provided on the side plate 22*b*.

Figure 6:
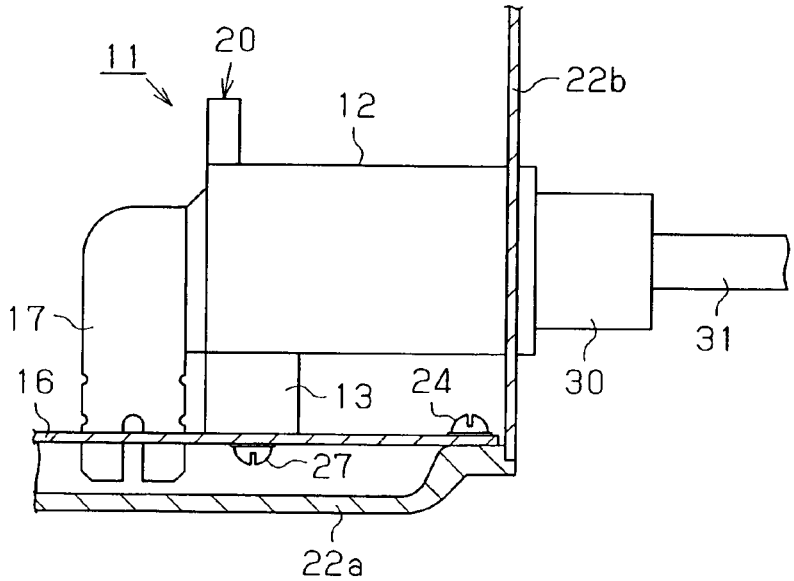
FIG. 6 is a partial cross-sectional view of the DC-AC inverter device showing the connection between the connector and an electric wire.
Figure 7:
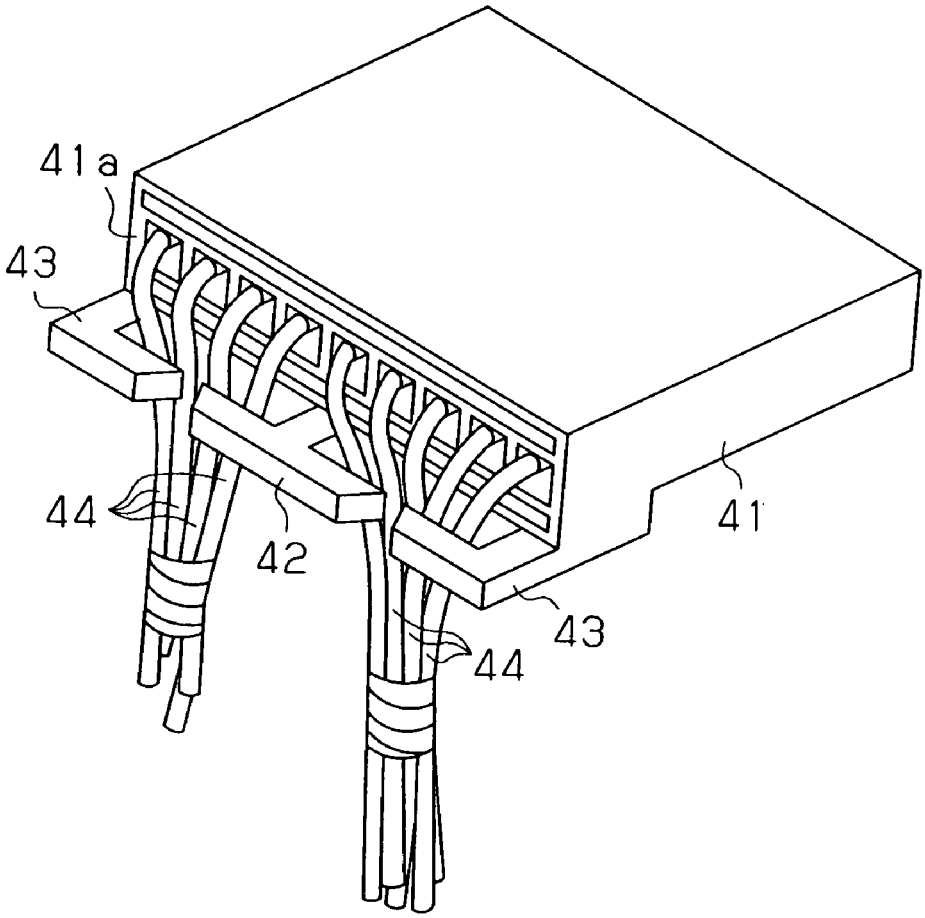
Fig.7 (Prior Art)
FIG. 7 is a perspective view showing a conventional connector.

The connector 11 is mounted on the printed circuit board 16 at a position corresponding to a corner of the case 22. The lower ends of the legs 17 of the connector 11 are inserted through holes formed in the printed circuit board 16. A pad (not shown) is provided around each of the holes. The legs 17 are electrically connected to the respective pads with solder. As shown in FIG. 6, the connector 11 is fixed to the printed circuit board 16 by a screw 27, which extends through the printed circuit board 16 to be mated with a threaded hole in the attachment portion 13. The connector 11 is attached to the case 22 such that the front end of the housing 12 is exposed to the outside of the case 22 through a hole formed in the side plate 22*b*.

Lead wires 28 extending from the cooling fan unit 26 have ends connected to a plug 29. The plug 29 is electrically connected to a connection terminal that is provided on the printed circuit board 16 in the vicinity of the connector 11. The lead wires 28 extending from the plug 29 to the cooling fan unit 26 are laid out to pass by the side surface of the connector 11 and over the connector 11. An intermediate part of the lead wires 28 is thus fixed to the connector 11 by the two latches 20 provided on the top wall 12*d*.

The electrical components 23 mounted on the printed circuit board 16 are covered by a cover member 22*c*, which is fixed to the base plate 22*a*. In this state, the lead wires 28 are held in the gap between the inner surface of the cover member 22*c* and the electrical components 23. This prevents the lead wires 28 from being caught between the cover member 22*c* and the base plate 22*a* when the cover member 22*c* of the case 22 is attached to the base plate 22*a*. Further, friction between the cover member 22*c* and the lead wires 28 prevent the plug 29 from falling off from the connection terminal of the printed circuit board 16 when removing the cover member 22*c*.

The DC-AC inverter device 21 is supplied with power from a vehicle battery, converts the DC battery power to AC power, and outputs the AC power from its output terminal (not shown). As shown FIG. 6, an electric wire 31 having a wire-side female connector 30 is connected to the connector 11 during use. The wire-side connector 30 is inserted into the connector insertion portion 12*f* with the electric wire 31 extending towards the front of the connector 11 from the front end face of the connector 11 so that the electric wire 31 is connected to the input terminals 14 of the connector 11. The electric wire 31 supplies the vehicle battery power to the DC-AC inverter device 21 via the input terminals 14.

This embodiment has the advantages described below.

(1) The connector 11 has the housing 12, the connector insertion portion 12*f* defined in the housing 12 to receive the wire-side connector 30 located on the end of the electric wire 31, and the input terminals 14 (connector connection portion) located in the housing 12 for connection with the wire-side connector 30 inserted into the connector insertion portion 12*f*. The latches 20 are provided on a face other than the end face of the housing 12 where the connector insertion portion 12*f* is provided so that the latches 20 do not intersect with a hypothetical plane including that end face. Accordingly, when using the connector 11 in a state fixed to the printed circuit board 16, the lead wires 28 laid out in the vicinity of the connector 11 are fixed at a predetermined position without providing any special clamping component on the printed circuit board 16 and without interfering with the wire-side connector 30 or electric wire 31 connected to connector 11.

(2) The connector 11, which is provided with the legs 17, is fixed to the printed circuit board 16 more easily than when not provided with the legs 17.

(3) In the connector 11, the latches 20 extend vertically from the top wall 12*d* of the housing 12, namely, from the wall opposite to the wall (bottom wall 12*a*) that faces the printed circuit board 16 when the connector 11 is attached to the printed circuit board 16. This makes it easy to fix the lead wires 28 arranged in the vicinity of the connector 11 to a predetermined position without interfering with the wire-side connector 30 or electric wire 31 connected to the connector 11 even if electrical components are present around the connector 11.

(4) In the connector 11, the latch 20 includes a pair of hooks (latching pieces 20*a* and 20*b*) that are flexible and face each other. This enables the wiring (lead wire) of an electrical component to be fixed at a latching position between the pair of hooks through a one-touch operation.

(5) In the connector, the legs 17 also function as electrode terminals. Therefore, the configuration of the connector is more simplified than when electrode terminals electrically connected to the wiring on the printed circuit board 16 are provided separately from the input terminals 14.

(6) The window 19 is formed in the right side wall 12*b* of the housing 12. This enables a tool to be inserted through the window 19 to move the wire-side connector 30 away from the input terminals 14 when detaching the wire-side connector 30 from the connector 11, which is firmly engaged with the wire-side connector 30.

In the above embodiment, the connector 11 is a male-type connector having male-type terminals as the input terminals 14. However, the connector 11 is not limited to such male-type connector and may be a female type having female-type terminals.

In addition to the side opposite to the end face of the housing 12 to which the wire-side connector 30 is connected, or the end face of the housing 12 located on the side in which the wire-side connector is inserted, the latches 20 may be provided in other sides where they do not intersect with a hypothetical plane including that end face. Accordingly, the latches 20 need not necessarily be formed at the rear end of the top wall 12*d* but may be formed in an intermediate area of the top wall 12*d*. Further, the latches 20 need not necessarily be formed on the top wall 12*d* but may be formed on the right side wall 12*b* or the left side wall 12*c*. However, it is still preferable to provide the latches 20 on the top wall 12*d*. This is because, when the connector 11 and other electrical components are mounted on the printed circuit board 16 with a decreased distance therebetween in order to reduce the size of the DC-AC inverter device 21, the latch 20 and the lead wire fixed by the latch 20 will less likely interfere with the electrical components if the latch 20 is on the top wall 12*d*.

The input terminals 14 and the legs 17 of the connector 11 may be formed integrally with the conductive member 15. Further, instead of the structure in which the legs 17 also function as terminal electrodes connected to the terminals on the printed circuit board 16, the connector 11 may be fixed to the printed circuit board 16 with only legs made of an insulative material (attachment portions 13). In this case, the input terminals 14 may be electrically connected to the terminals on the printed circuit board 16 by wires.

Instead of the input terminals 14 of the DC-AC inverter device 21, the connector 11 may have output terminals of the DC-AC inverter device 21 function as the connector connection portion.

The latch 20 is not limited to a structure in which it fixes two lead wires 28 and may fix a single lead wire or three or more lead wires. The size of and the distance between the latching pieces 20*a* and 20*b* may be changed depending on the number and thickness of the fixed lead wires.

The latch 20 does not necessarily have a pair of latching pieces 20*a* and 20*b* facing each other.

The connector of the present invention is applicable not only to the on-vehicle DC-AC inverter device 21 but also to other inverter devices.

The present invention is applicable not only to a connector for use in the DC-AC inverter device 21 or other inverter devices but also to a connector mounted on a printed circuit board of an electrical device.

It should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope and equivalence of the appended claims.

What is claimed is:

1. A connector comprising:

a housing;

a connector insertion portion, defined in the housing, for insertion of a wire-side connector that is arranged on an end of an electric wire;

a connector connection portion, arranged on the housing, for connection with the wire-side connector in a state in which the wire-side connector is inserted in the connector insertion portion, wherein the connector connection portion includes a pair of input terminals each formed by a conductive member;

a latch arranged on a face other than an end face of the housing in which the connector insertion portion is arranged such that the latch does not interfere with a hypothetical plane including the end face, wherein the latch is flexible and includes a pair of hooks arranged facing each other; and a plurality of legs for supporting the housing, wherein a pair of the legs are formed at the housing and at least one of the legs is integrally formed with at least one of the input terminals to function as an electrode terminal.

2. The connector according to claim 1, wherein the housing is formed by a rectangular tube having an open end and a closed end, and the housing includes a bottom wall and a top wall, the housing being attached to a printed circuit board at the bottom wall, and the latch extending vertically from the top wall.

3. A connector comprising:

a tube-shaped housing including an open end and a closed end;

a connector connection portion arranged inside the housing, wherein a wire-side connector is inserted into the housing through the open end of the housing to connect the wire-side connector to the connector connection portion, and during connection, an electric wire extends from the wire-side connector out of the housing, wherein the connector connection portion includes a pair of input terminals each formed by a conductive member;

a latch arranged at a side opposite side from the open end of the housing, wherein the latch is flexible and includes a pair of hooks arranged facing each other; and a plurality of legs for supporting the housing, wherein a pair of the legs are formed at the housing and at least one of the legs is integrally formed with at least one of the input terminals to function as an electrode terminal.

4. The connector according to claim 3, wherein the latch is provided in the vicinity of the closed end of the housing.

5. A connector comprising:

a housing;

a connector connection portion, arranged on the housing, for connection to a wire-side connector that is arranged on an end of an electric wire, wherein the connector connection portion includes a pair of input terminals each formed by a conductive member;

a latch located on the housing at a side opposite to a side of an end face through which the wire-side connector is inserted into and from which the electric wire extends, wherein the latch is flexible and includes a pair of hooks arranged facing each other; and a plurality of legs for supporting the housing, wherein a pair of the legs are formed at the housing and at least one of the legs is integrally formed with at least one of the input terminals to function as an electrode terminal.

6. The connector according to claim 2, wherein the housing has a side wall having a window to insert a tool for moving a wire-side connector away from the input terminals.

* * * * *